United States Patent [19]

Colgate, Jr.

[11] Patent Number: 4,547,002

[45] Date of Patent: Oct. 15, 1985

[54] CREDIT AND IDENTIFICATION CARDS HAVING PIECES OF DIFFRACTION GRATING THEREIN

[75] Inventor: Gilbert Colgate, Jr., New York, N.Y.

[73] Assignee: U.S. Banknote Corporation, New York, N.Y.

[21] Appl. No.: 550,401

[22] Filed: Nov. 10, 1983

[51] Int. Cl.[4] ..... B42D 15/00

[52] U.S. Cl. ..... 283/91; 264/132; 283/85; 283/86; 283/87; 283/904

[58] Field of Search ..... 264/132, 140, 160; 283/75, 74, 76, 77, 106, 107-112, 904, 85-91

[56] References Cited

U.S. PATENT DOCUMENTS 3,552,853 1/1971 Sanders et al. ..... 283/109 X 4,101,701 7/1978 Gordon ..... 283/904 X

*Primary Examiner*—Paul A. Bell

*Attorney, Agent, or Firm*—Cushman, Darby & Cushman

[57] ABSTRACT

An information bearing credit or identification card in which pieces of a diffraction grating, preferably an embossed hologram, are randomly distributed in a plastic or paper card so that light reflecting therefrom uniquely and visually differentiates the grating and hence the card. The pieces may be mixed in the plastic pig or with the paper prior to rolling or sprinkled in the plastic or other substrate during rolling.

5 Claims, 3 Drawing Figures

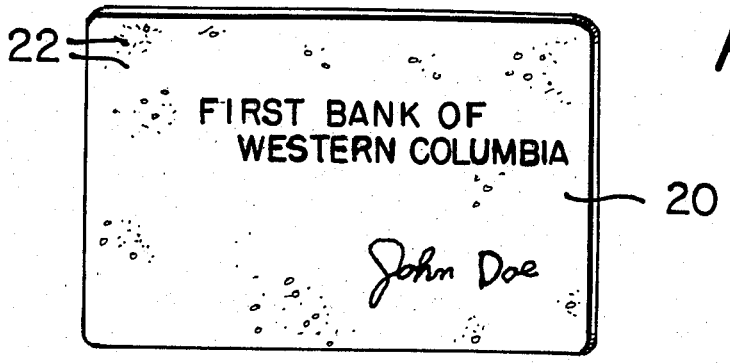
FIG. 1
FIG. 2
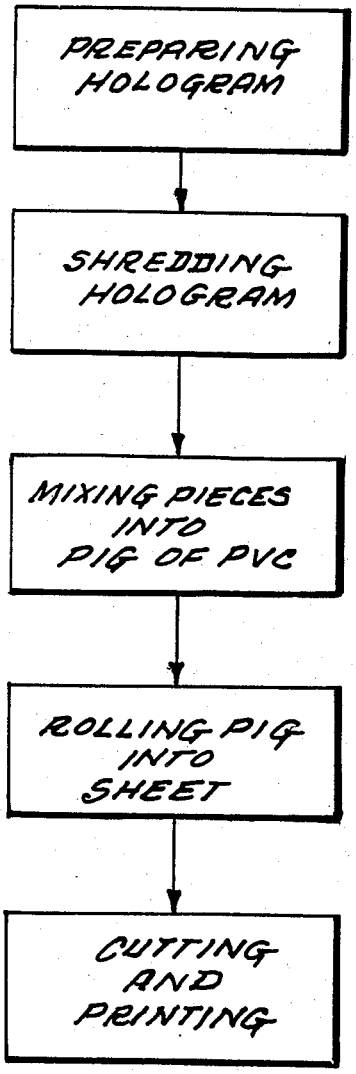
FIG. 3
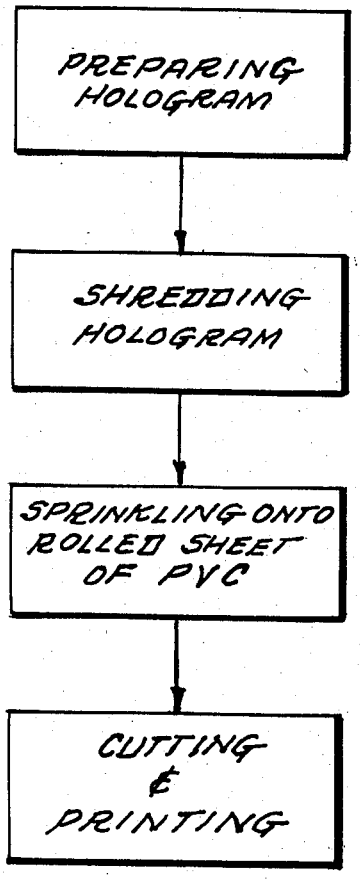

CREDIT AND IDENTIFICATION CARDS HAVING PIECES OF DIFFRACTION GRATING THEREIN

BACKGROUND AND SUMMARY OF THE INVENTION

The invention relates to an information bearing card such as a credit card or an identification card and a method of making the same.

Credit cards are normally made of a standard plastic substrate of PVC (polyvinylchloride) on which information is printed, embossed or stored in the form of a magnetic strip or the like. Unlike paper which can be watermarked and manufactured with various modifications which make its identification and origin reasonably and sometimes definitely certain, all PVC is very much the same and its origin cannot be differentiated even under laboratory analysis.

Forgery and illegal use of credit cards is a multimillion dollar industry within the United States. Embossing plastic sheets to resemble valid credit cards is not technically difficult and such credit cards are substantially indistinguishable from valid cards. Discovery of the illegal use normally occurs only when someone whose valid card has the same number as the illegal card complains that he has received a bill for items which he did not purchase. Typically, this occurs only some weeks or months after the illegal use by which time the counterfeiter has ceased use of the card and began use of another illegal card. Furthermore, even when the illegal user of the card is apprehended, it is virtually impossible to trace the card to the manufacturer thereof in a way which would permit prosecution of that individual or entity.

Various plastic manufacturers have attempted to personalize their product with the inclusion of bits of foreign matter. Bronze powder and the like have been introduced into the PVC. While of some benefit, this approach is not a complete solution since sophisticated counterfeiters have access to similar foreign matter and can simply adjust their processes to add the same material.

Another approach has been to include within the card or to add to the card a diffraction grating, preferably a hologram. The hologram can be actually embodied in the card, for example as shown in U.S. Pat. No. 3,620,590, or attached thereto in the form of a sticker. Such a hologram is difficult for counterfeiters to duplicate and provides a simple visual check of the validity of a card presented for credit. Even should counterfeiters be able to produce a holographic image resembling that on the card, the hologram can be made to have unique spectral characteristics which cannot be readily duplicated.

However, such holograms forming part of a credit card present a number of disadvantages. First, the use of a sticker hologram forming an image, or even a colorful pattern, is expensive and incorporating a holographic or diffraction pattern within the card is even more expensive. The stickers or holograms can be removed from valid cards or fake holograms added so that their potential for use illegally still exists.

The present invention relates to a unique information bearing card and method of forming the same. According to the present invention, a diffraction grating, for example a hologram embossed upon a polyester or paper sheet or the like, is shredded into pieces and distributed, preferably randomly, in a conventional plastic sheet of PVC or at the head box of the paper manufacturer. The pieces of the diffraction grating each reflect light having unique optical characteristics in accordance with the way that the diffraction grating is formed. Not only does this provide a simple visual check to see if a card comes from an authorized source, but the light reflected can be analyzed for example by spectrography, to determine quickly, easily and with accuracy the source or the manufacturer of the plastic blanks. Moreover, since the pieces are distributed in the card, if one or more of these should become obscured for any reason, the remaining pieces will still provide the same response to incident light.

The pieces of the diffraction grating can be added to the PVC sheets in at least two different ways. After shredding, the pieces can be simply mixed with the dough-like substance resulting from mixing of powdered resins and liquid chemicals called a "pig". This pig is conventionally then rolled into sheets and cut into credit card blanks. Alternatively, the shredded pieces can simply be sprinkled into the sheet as it is rolled so that the pieces are lodged near the surface on one side of the sheet.

Alternatively the pieces of diffraction grating can be incorporated in some other substrate, such as paper, by adding in the same way during manufacture.

Other objects and purposes of the invention will be clear from the following detailed description of the drawings.

BRIEF DESCRIPTION OF THE DRAWINGS

FIG. 1 shows a perspective view of a unique information bearing card such as a credit card according to the present invention;

FIG. 2 shows a block diagram of a first method for manufacturing the card of FIG. 1; and FIG. 3 shows a block diagram of a second method of manufacturing the card of FIG. 1.

DETAILED DESCRIPTION OF THE DRAWINGS

FIG. 1 shows an information bearing card such as a credit card which is formed of a plastic or other substrate 20 having a plurality of shredded pieces 22 of a diffraction grating, preferably a hologram, dispersed therein as will be described later. Paper can be used as a substrate.

A hologram carries within each element of interference the information of the total hologram whether it be a Fourier transform hologram in a single lens focus or a blazed focus hologram or in a diffraction grating made in any of a number of different ways. Such holograms can be embossed upon a metallized polyester and the polyester can be easily shredded in a conventional paper shredder, slitter or cutter, into pieces which can be distributed preferably randomly, within a standard plastic or other substrate. The sizes of the pieces are not critical and can be chosen as desired to produce a pleasing visual impression. The pieces are preferably distributed randomly, but could be distributed to form any desired pattern. When analyzed under a spectroscope, each diffraction grating will present the same light characteristics depending upon the frequencies of the polychromatic or monochromatic light beams which were used to form the diffraction grating and the angles at which the light beams were incident. When polychromatic or monochromatic light is incident thereon the spectral characteristics of the reflected light uniquely and visually identify the grating and therefore the card source. By selecting different frequencies and angles an almost infinite number of possibilities exist which can be used to uniquely code the source of a given card or a given batch of cards.

Referring to FIG. 2, the card of the present invention can be made by preparing a hologram according to conventional techniques and then shredding that hologram in a conventional paper shredder, slitter or cutter or the like. The pieces resulting from shredding can then be mixed into a pig of PVC and the pig rolled into sheets which are then cut and printed. According to the alternative method of FIG. 3, the shredded pieces of hologram are simply randomly sprinkled onto the rolled sheet of PVC before the card is cut and printed. If desired the substrate can be covered with a clear layer and heat sealed thereto.

Many changes and modifications in the above described embodiment can, of course, be carried out. The present invention finds utility not only with PVC substrates but similar plastic arrangements including spun plastic "paper like" substances which are printed. Accordingly, the scope of the present invention is intended to be limited only by the scope of the attached claims.

What is claimed is:

1. An information bearing card with a substrate having an extended surface with a plurality of pieces of a diffraction grating randomly distributed therein and each, in response to incident light, reflecting light having unique optical characteristics uniquely and visually identifying the grating and therefore the card source.

2. A card as in claim 1 wherein said substrate is paper.

3. A card as in claim 1 wherein said substrate is plastic.

4. A card as in claim 3 wherein said plastic is PVC.

5. A card as in claim 1 wherein the diffraction grating is a hologram embossed on a polyester sheet.

* * * * *